US005881685A

United States Patent [19]

Foss et al.

[11] Patent Number: 5,881,685

[45] Date of Patent: Mar. 16, 1999

[54] FAN SHROUD WITH INTEGRAL AIR SUPPLY

[75] Inventors: John F. Foss; Scott C. Morris, both of Okemos, Mich.

[73] Assignee: Board of Trustees operating Michigan State University, East Lansing, Mich.

[21] Appl. No.: 923,886

[22] Filed: Sep. 4, 1997

Related U.S. Application Data

[63] Continuation-in-part of Ser. No. 585,880, Jan. 16, 1996, Pat. No. 5,762,034.

[51] Int. Cl.[6] ..... F04D 29/54

[52] U.S. Cl. ..... 123/41.49

[58] Field of Search ..... 123/41.49, 41.48; 165/51

[56] References Cited

U.S. PATENT DOCUMENTS

| | | | |
|---|---|---|---|
| 2,785,620 | 3/1957 | Welch | 98/2 |
| 3,799,128 | 3/1974 | Small | 123/41.49 |
| 3,937,189 | 2/1976 | Beck | 123/41.49 |
| 3,937,192 | 2/1976 | Longhouse | 123/41.49 |
| 4,104,993 | 8/1978 | Baguelin | 123/41.49 |
| 4,181,172 | 1/1980 | Longhouse | 165/51 |
| 4,202,296 | 5/1980 | Nonnenmann et al. | 123/41.48 |
| 4,329,946 | 5/1982 | Longhouse | 123/41.49 |
| 4,398,508 | 8/1983 | Moon et al. | 123/41.49 |
| 4,406,581 | 9/1983 | Robb et al. | 415/172 |
| 4,548,548 | 10/1985 | Gray, III | 416/189 |
| 4,566,852 | 1/1986 | Hauser | 415/182 |
| 4,685,513 | 8/1987 | Longhouse et al. | 165/121 |
| 4,768,472 | 9/1988 | Hayashi et al. | 123/41.49 |
| 4,927,328 | 5/1990 | Scoates et al. | 415/220 |
| 5,216,983 | 6/1993 | Nilson | 123/41.12 |
| 5,279,503 | 1/1994 | Propst | 417/319 |
| 5,590,624 | 1/1997 | Emond et al. | 123/41.49 |
| 5,701,854 | 12/1997 | Hauser | 123/41.49 |

*Primary Examiner*—David A. Okonsky
*Attorney, Agent, or Firm*—Brinks Hofer Gilson & Lione

[57] ABSTRACT

A shroud for an axial blade fan provides a circumferential, axially directed flow of air between the fan blade tips and the shroud to improve fan efficiency. The shroud preferably includes a smaller, centrally disposed fan which is driven by an auxiliary motor, a circumferentially extending generally toroidal plenum, a plurality of hollow spokes providing fluid communication between the fan and the plenum, a circular throat which directs air toward the annulus between the shroud and the fan blade tips and a throat adjacent, circumferential Coanda surface which controls and guides air exiting the throat. Air is provided to the shroud plenum at a pressure of between about 2 and 10 inches water gauge (4 to 20 Torr). The narrowest region of the circular throat has a width of between about 1 mm to 5 mm. Adjustment of the air pressure and throat dimension allows accurate control of the velocity profile of the air flow through the annulus.

20 Claims, 11 Drawing Sheets

FIG. 4
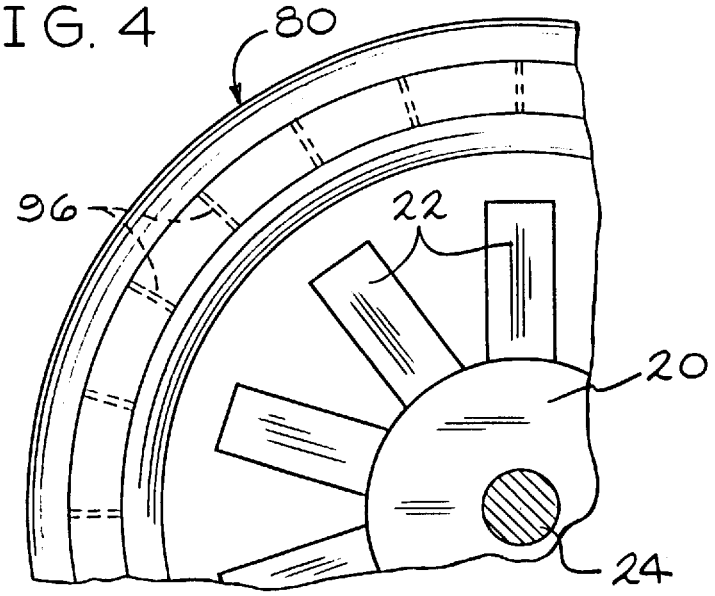
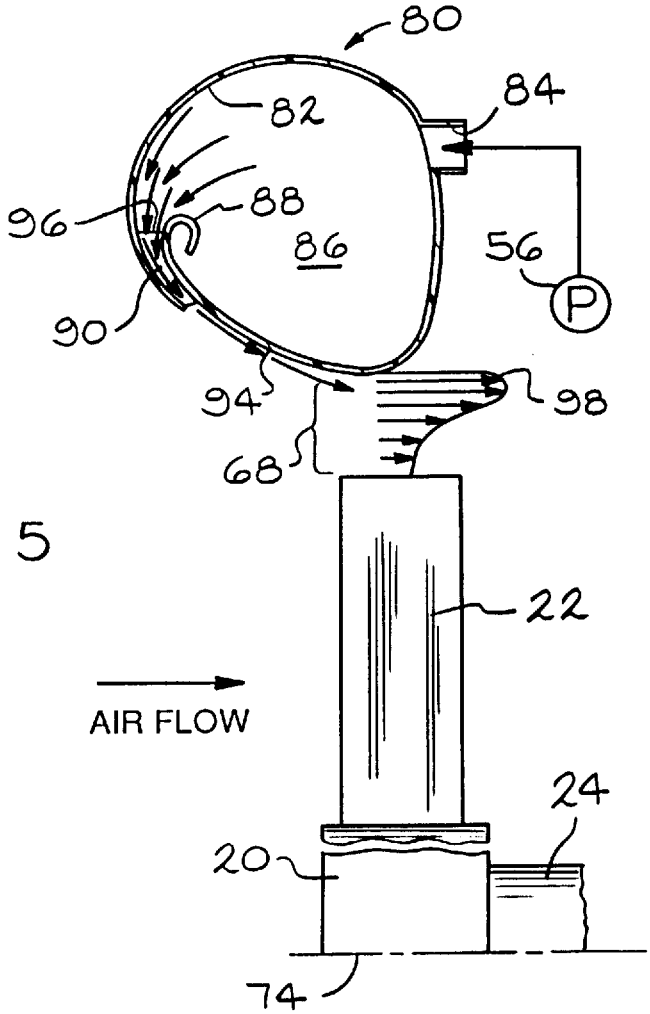
FIG. 5

FAN SHROUD WITH INTEGRAL AIR SUPPLY

CROSS REFERENCE TO CO-PENDING APPLICATION

This patent application is a continuation-in-part application of Ser. No. 08/585,880 filed Jan. 16, 1996 now U.S. Pat. No. 5,762,034.

BACKGROUND OF THE INVENTION

The invention relates generally to shrouds for motor vehicle cooling fans and more particularly to a shroud for a motor vehicle engine cooling fan which utilizes a Coanda surface to provide air flow through the annulus between the fan blade tips and the shroud and includes an integral air supply.

As motor vehicle engine compartment designs continue to evolve in response to increasing demands of vehicle and engine efficiency, operating temperatures continue to increase while the engine compartment's frontal area and natural air flow continue to reduce. All of these considerations conspire to increase underhood operating temperatures.

Nonetheless, a vehicle traveling at highway speeds at elevated ambient temperatures presents no significant engine cooling problems. Likewise, a vehicle stopped in traffic in moderate ambient temperatures presents no significant cooling problems. The combination, however, of high ambient temperatures and operation in congested, slow moving traffic wherein air heated by one vehicle is ingested by an adjacent vehicle and heated further represents an acknowledged severe engine operating condition. A second severe operating condition known as "hot soak" occurs when the engine has been subjected to heavy load by, for example, pulling a trailer uphill and the vehicle then stops. Operation under these conditions demands operation of and dependence upon the engine driven cooling fan. Operation in these conditions also demands the highest possible efficiency from the fan in order to achieve maximum cooling and safe engine operating conditions.

Such fan efficiency is achieved by well-known and recognized parameters such as the number of fan blades and their configuration as well as a properly designed radiator/fan shroud which maximizes radiator air flow and heat transfer while minimizing leakage and back flow around the fan.

In this regard, a problem inherent in motor vehicle design typically interferes with the attainment of high fan efficiencies. This problem results from the mounting of the radiator and fan shroud to the vehicle body whereas the fan is mounted upon the engine which is, in turn, secured to the vehicle body or frame through a plurality of engine mounts. These engine mounts are typically resilient and allow controlled motion of the engine and associated drive train components relative to the body or frame in response to engine reaction torque and vehicle acceleration and deceleration. While the spacing of the fan tips from the shroud can vary depending upon the fan and shroud location relative to the engine mount, the stiffness of the engine mounts and other variables, it has been found that spacing on the order of one-half inch (12.7 mm) to one inch (25.4 mm) or more is necessary to ensure that given the greatest excursion of the engine and fan relative to the shroud and vehicle body, the fan does not contact the shroud.

Unfortunately, the introduction of an annular space of this size has a significant deleterious effect on fan efficiency. Fan efficiencies in such configurations have been determined to be on the order of sixteen percent. Viewed not only from the perspective of fan efficiency but also from the perspectives of achieving necessary engine cooling with a given fan size and overall engine efficiency and fuel consumption, this is not a desirable figure. Accordingly, it is apparent that improvements in the configuration of motor vehicle cooling fans which provide improved fan efficiency and thus motor vehicle cooling are desirable.

SUMMARY OF THE INVENTION

A shroud for an axial blade fan provides a circumferential, axially directed flow of air between the fan blade tips and the shroud to improve fan efficiency. The shroud preferably includes a smaller, centrally disposed fan which is driven by an auxiliary motor, a circumferentially extending generally toroidal plenum, a plurality of hollow spokes providing fluid communication between the fan and the plenum, a circular throat which directs air toward the annulus between the shroud and the fan blade tips and a throat adjacent, circumferential Coanda surface which controls and guides air exiting the throat. Air is provided to the shroud plenum at a pressure of between about 2 and 10 inches water gauge (4 to 20 Torr). The narrowest region of the circular throat has a width of between about 1 mm to 5 mm. Adjustment of the air pressure and throat dimension allows accurate control of the velocity profile of the air flow through the annulus. An alternate embodiment in which the auxiliary motor also drives the engine cooling fan is also disclosed.

It is thus an object of the present invention to provide a motor vehicle cooling fan shroud which provides increased fan efficiency.

It is a further object of the present invention to provide a motor vehicle cooling fan shroud which utilizes the Coanda effect to improve fan efficiency.

It is a still further object of the present invention to provide a motor vehicle cooling fan shroud wherein adjustment of the air pressure provided to the shroud plenum and adjustment of the dimensions of the outlet throat may be made to control the velocity profile of the air passing between the fan blade and the shroud.

It is a still further object of the present invention to provide a motor vehicle cooling fan shroud which reduces back flow through the annulus between the tips of the fan blade and the shroud.

It is a still further object of the present invention to provide a motor vehicle cooling fan shroud which provides good fan efficiency notwithstanding the existence of a significant annular space between the fan blade tips and shroud.

It is a still further object of the present invention to provide a motor vehicle cooling fan shroud having an integral air supply which supplies air to a circumferential Coanda surface.

It is a still further object of the present invention to provide a motor vehicle cooling fan shroud having an integral motor which drives both the motor cooling fan and a fan for providing air to a circumferential Coanda surface.

Further objects and advantages of the present invention will become apparent by reference to the following description of the preferred and alternate embodiments and appended drawings wherein like reference numbers refer to the same element, feature or component.

BRIEF DESCRIPTION OF THE DRAWINGS

FIG. 4 is fragmentary view of a portion of motor vehicle cooling fan and first alternate embodiment shroud according to the present invention;

FIG. 5 is fragmentary view in partial section of a motor vehicle cooling fan and first alternate embodiment shroud according the present invention;

DESCRIPTION OF THE PREFERRED AND ALTERNATE EMBODIMENTS

Figure 1:
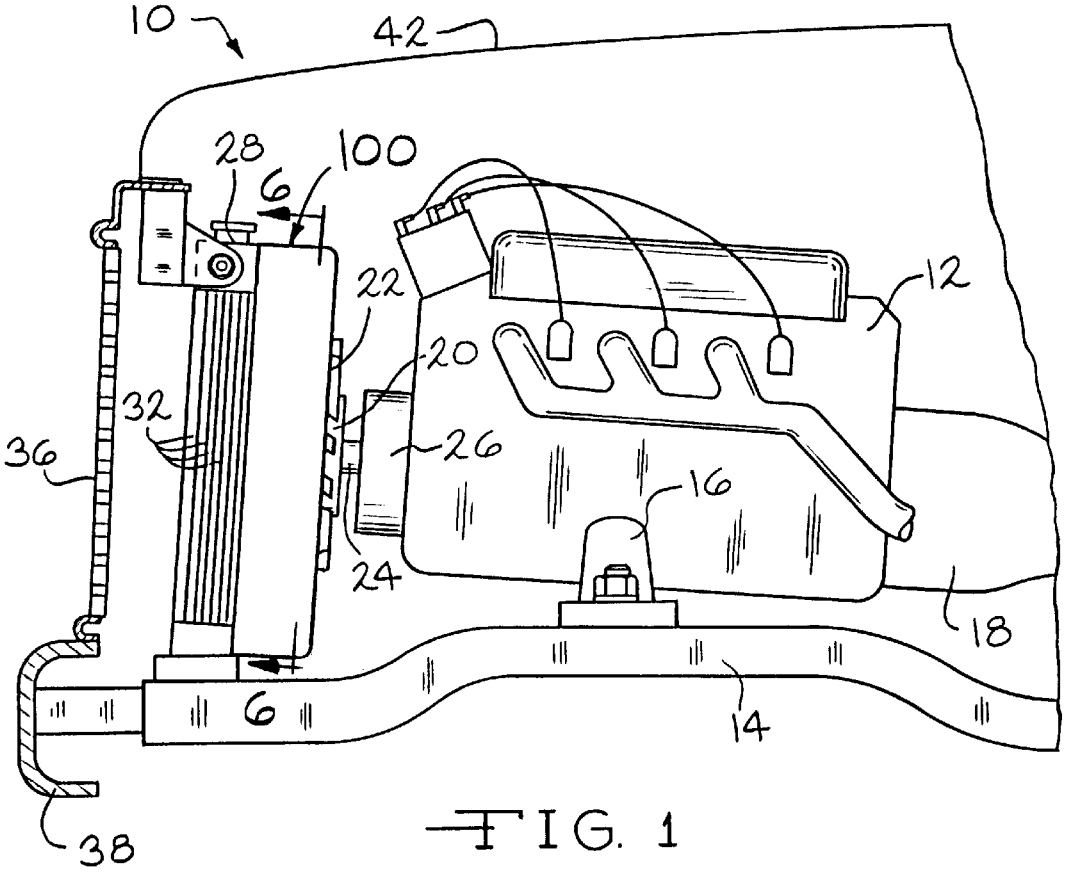
FIG. 1 is a diagrammatic side, elevational view in partial section of a motor vehicle engine cooling fan, radiator and shroud according to the present invention.

Referring now to FIG. 1, a forward portion of a motor vehicle is illustrated and generally designated by the reference numeral 10. The motor vehicle 10 includes a prime mover 12 which may be either a Diesel engine, Otto cycle engine as illustrated or other heat generating power plant. The prime mover 12 is secured to the frame 14 or other body structure by a plurality of resilient engine mounts 16 one of which is illustrated in FIG. 1. The engine mounts 16 damp vibration and allow limited and controlled motion of the prime mover 12 relative to the frame or unibody 14 of the motor vehicle 10. The power generated by the prime mover 12 is transferred through a transmission 18 to associated driveline components (not illustrated). At the forward end of the prime mover 12, generally centrally disposed thereon is a fan 20 having a plurality of radially and obliquely oriented fan blades 22. The fan 20 may be disposed upon a shaft 24 of a water pump 26 or may be independently mounted, as desired. Forward of the fan 20 is a radiator 28. The radiator 28 is conventional and functions as a heat exchanger, receiving a flow of engine coolant through internal, vertical or horizontal passageways 32. The engine coolant gives up heat to air which moves horizontally, that is, from left to right in FIG. 1, through the radiator 28.

A decorative grill 36 is disposed forward of the radiator 28 and provides an attractive appearance as well as a modicum of protection to the radiator 28. A bumper 38 is secured to the frame or unibody 14 and also protects the forward end of the motor vehicle 10. A hinged hood 42 covers the prime mover 12 and other components in the engine compartment as will be readily appreciated.

Figure 2:
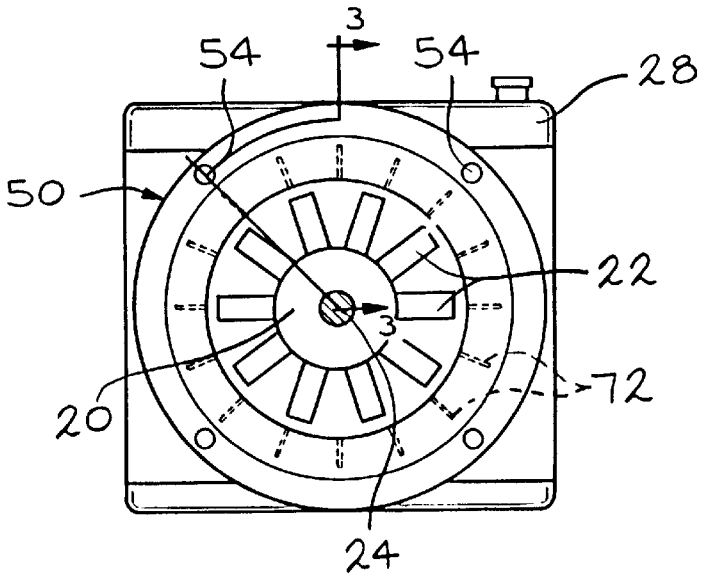
FIG. 2 is a rear, elevational view of a motor vehicle cooling fan, radiator and shroud according to the present invention.

Referring now to FIGS. 1 and 2, disposed intermediate and proximate the fan 20 and radiator 28 is a fan shroud 50. The fan shroud 50 is secured to and moves with the radiator 28 which, in turn, is securely fastened to the frame or unibody 14. As noted above, since the fan 20 is attached to the prime mover 12 and the prime mover 12 is secured to the frame or unibody 14 through resilient engine mounts 16, relative motion can and does occur between the fan 20 and the fan shroud 50. In a typical truck application, it has been found necessary to allow approximately one inch (25.4 mm) clearance between the tips of the fan blades 22 and the most proximate, that is, radially adjacent and aligned, surface of the fan shroud 50. Assuming the fan 22 defines a diameter of 20 inches (508 mm), the one inch (25.4 mm) annular spacing between the tips of the blade 22 and the fan shroud 50 constitutes an area of 66 square inches (425.4 square cm). Given such a fan and shroud configuration, fan efficiencies on the order of 16% have been observed. It is believed that such efficiencies are the result of significant backflow through the annulus defined by the tips of the fan blades 22 and the most proximate surface of the fan shroud 50. The imposed axial flow will also limit the localized flow from the pressure-side to the suction-side of the fan blade. Thus localized flow contributes to the "tip loss" phenomenon of such fans.

Figure 3:
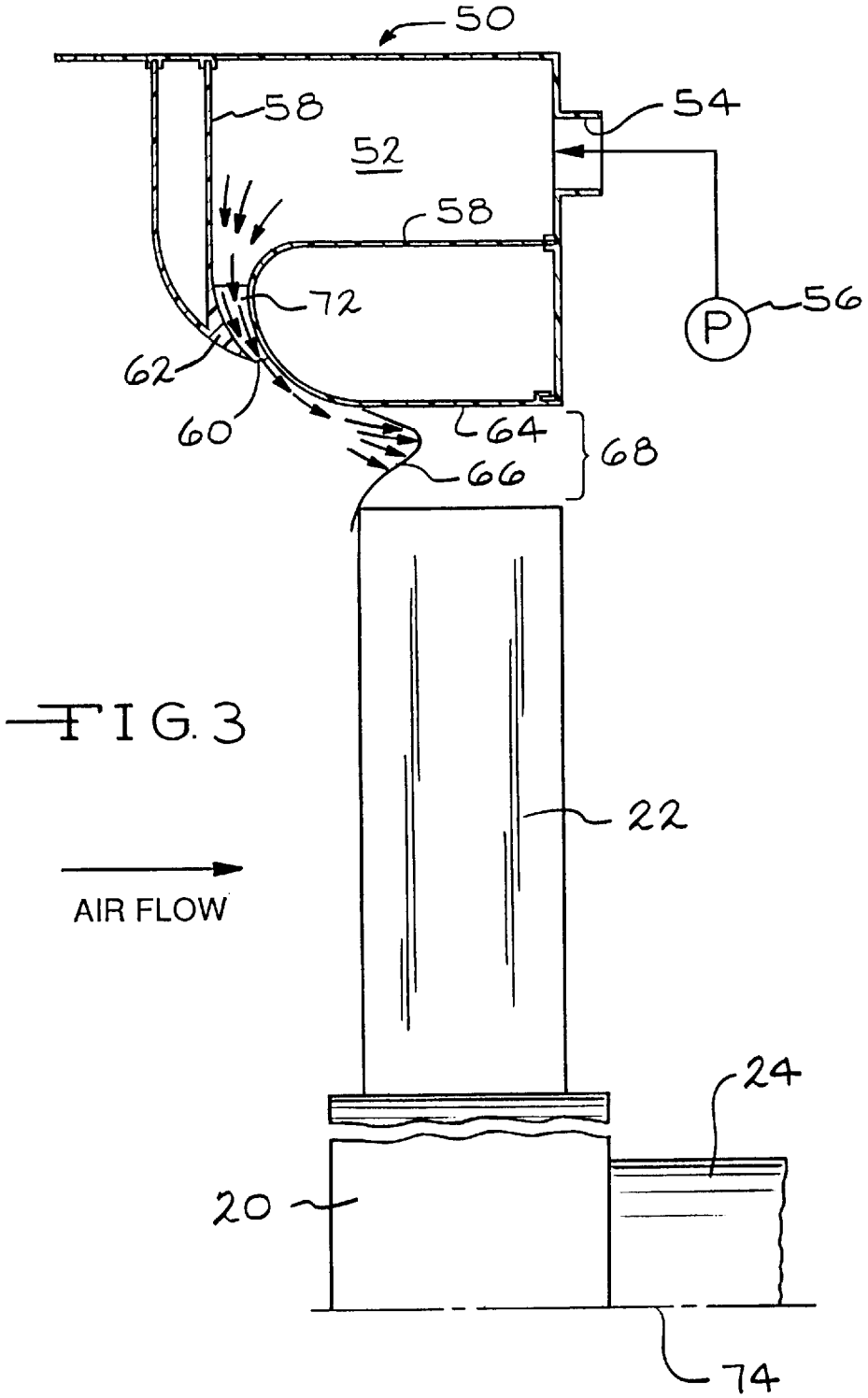
FIG. 3 is a fragmentary, sectional view of a motor vehicle cooling fan and shroud according to the present invention taken along line 3—3 of FIG. 2.

Referring now to FIGS. 2 and 3, the fan shroud 50 defines a circumferentially continuous interior passageway or plenum 52. The circumferential plenum 52 preferably is in fluid communication with a plurality of inlet ports 54 which, in turn, communicate with one or more sources of low pressure air such as a pump 56. Although a single inlet port 54 will suffice to pressurize the plenum 52 improved air distribution and operation is achieved with multiple ports 54. The air is preferably provided at a pressure of between about 3 to 5 inches of water gauge or about 6 to 10 Torr. Depending upon the flow characteristics desired, the pressure in the engine compartment and other variables, it is anticipated that an operable range for such air pressure is from about 2 to about 10 inches of water gauge (4 Torr to 20 Torr). The shroud 50 includes interior walls 58 which define the passageway or plenum 52 and converge to a throat 60. An overhanging lip 62 defines one portion of the throat 60 and the other portion of the throat 60 is defined by a curved circumferential Coanda surface 64. The Coanda surface 64 causes the air moving through the throat 60 to continue to curve along the Coanda surface 64 thereby providing an air flow having a representative velocity profile 66 and directing air flow through the annular space 68 between the Coanda surface 64 and the tips of the fan blades 22. A plurality of radially disposed webs 72 which span the throat 60 ensure maintenance of the desired width of the throat 60 and generally strengthen the shroud 50.

The interior walls 58, the throat 60, the lip 62 and the Coanda surface 64 are preferably axisymmetric about a center reference axis 74. Viewing the profile of the Coanda surface 64 and the overhanging lip 62, it will be appreciated that the utilization of a Coanda surface 64 not only achieves air flow in the annular space 68 but presents a smooth aerodynamic surface to the air passing through the peripheral regions of the radiator 28 as it moves towards the fan 20, thereby also improving fan efficiency.

Referring now to FIG. 4 and 5, a first alternate embodiment fan shroud is illustrated and designated by the reference numeral 80. The first alternate embodiment fan shroud 80 defines a formed or curled body having an axisymmetric shape suggestive of a torus. Thus the cross section illustrated in FIG. 5 generally represents the cross section of the fan shroud 80 about its circumference, with certain exceptions. The exceptions relate to the plurality of air inlet ports 84 which provide fluid communication into the interior or plenum 86 of the shroud 80 at a plurality of circumferential locations about the shroud 80. Once again, it is believed that a plurality of inlet ports 84 provide uniform airflow and thus optimum operation. However, it should be appreciated that construction and operation with, for example, a single or double inlet ports 84 is readily possible.

The continuous sidewall 82 of the shroud 80 is formed into a reverse curved terminal portion 88 on the interior which provides an appropriately streamlined surface as the air travels toward a throat 90. The throat 90 is, of course, defined by the continuous curved sidewall 82 which is a Coanda surface 94 which directs airflow into the annular space 68 between the tips of the fan blades 22 and the first alternate embodiment shroud 80. Circumferentially spaced around the shroud 80 at a plurality of locations between the portions of the sidewall 82 which define the throat 90 are webs 96 which maintain the shape of the throat 90 and thus maintain the desired air velocity profile 98 illustrated schematically in FIG. 5.

In this regard, it will be appreciated that the precise size and shape, that is, the profile of the curved Coanda surfaces 64 and 94 of the preferred and alternate embodiment shrouds 50 and 80, respectively, is not critical to obtaining a desired velocity profile. Rather, the width of the throats 60 and 90 and the pressure of the air provided to the plenums 52 and 86 of the shrouds 50 and 80, respectively provide readily adjustable parameters by which the velocity profile may be adjusted to provide optimum operation and fan efficiency in differing applications and operating conditions. Furthermore, the present invention is deemed to include the real time adjustment of air pressure delivered to the plenums 52 and 86 in response to one or more sensed variables such as underhood temperature, ambient temperature, engine compartment pressure or engine speed to change the velocity profile of the air delivered to the annular space 68 by the fan shrouds 50 and 80.

The preferred and first alternate embodiment shrouds 50 and 80, respectively, both incorporate the present invention but disclose differences based primarily on different approaches to the manufacture and assembly of the shrouds. The preferred embodiment shroud 50, as illustrated in FIG. 3, may be fabricated of three or more molded plastic pieces which are fit together with mating edges and channels aligned and then secured by suitable adhesives. The alternate embodiment shroud 80 illustrated in FIG. 5 is, however, preferably fabricated of a single piece of plastic molded material with edges which are curled and overlapped to form the final product. In either event, it is anticipated that the shrouds 50 and 80 may be molded of a temperature resistant plastic such as acrylonitrile-butadiene-styrene (ABS). In thermosetting form, i.e., cured or crosslinked, it is suitable for the fabrication of the preferred embodiment shroud 50. Alternatively, ABS in a thermoplastic form, i.e., uncured or non-crosslinked, is suitable for the molding of the alternate embodiment shroud 80 which requires additional forming (curling) after the initial molding.

Figure 6:
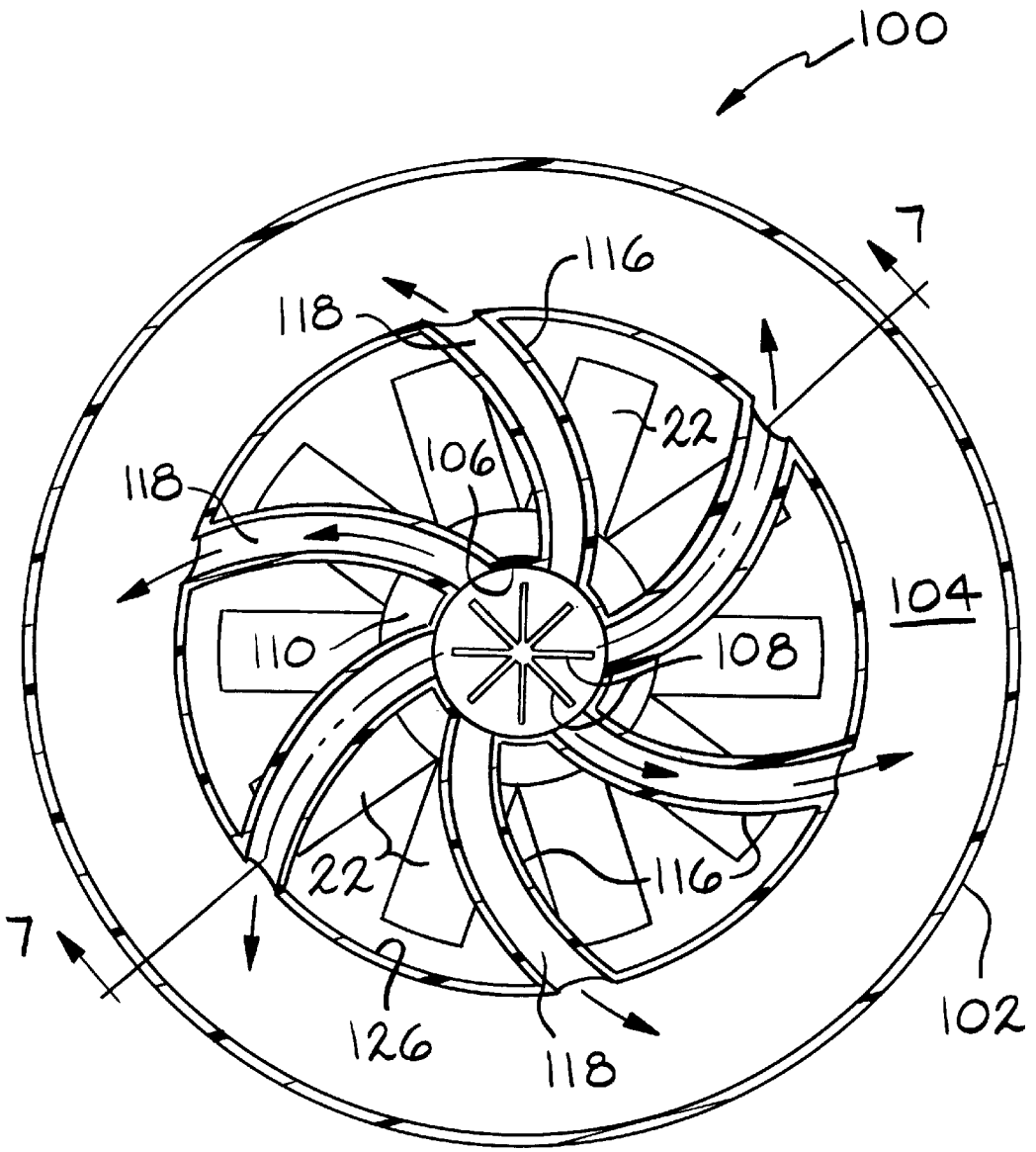
FIG. 6 is a full, sectional view of a second alternate embodiment fan shroud having an integral air supply according to the present invention taken along line 6—6 of FIG. 1.
Figure 7:
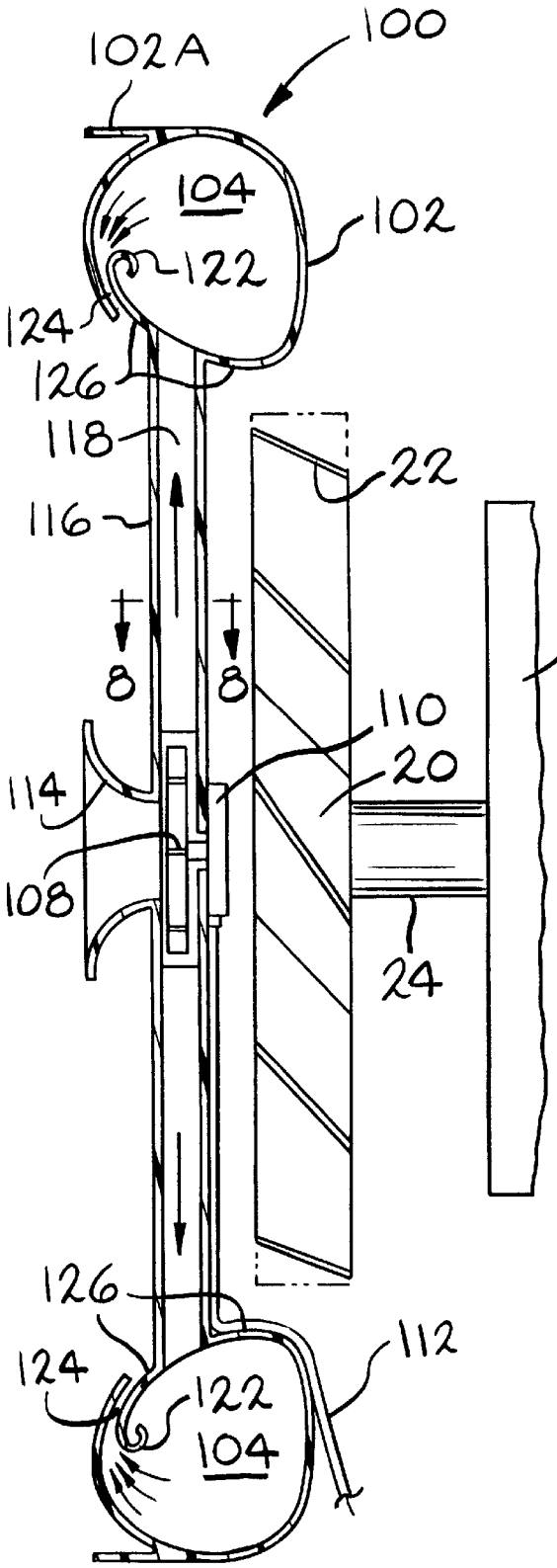
FIG. 7 is a full, sectional view of a second alternate embodiment fan shroud having an integral air supply according to the present invention taken along line 7—7 of FIG. 6.

Referring now to FIGS. 1, 6 and 7, a second alternate embodiment of a fan shroud assembly having an integral air supply is illustrated and generally designated by the reference number 100. As illustrated in FIG. 6, the fan shroud assembly 100 defines a generally toroidal housing 102 defining a toroidal plenum 104. The toroidal housing 102 may include axially tangential flanges 102A which seal against a radiator or other structure as well as outwardly directed mounting ears or lugs (not illustrated) which facilitate attachment of the fan shroud 102 to such adjacent structure. Centrally disposed within the fan shroud assembly 100, in a multiply internally scrolled housing 106, is a device for providing air under low pressure to the toroidal plenum 104 which takes the form of a radial blade paddle fan 108. The paddle fan 108 is coupled to and driven by a small auxiliary motor 110. Preferably, the motor 110 is a pancake style direct current motor which is driven by the electrical system of the vehicle 10 or other source. Alternatively, the auxiliary motor 110 may be hydraulically driven if a supply of pressurized hydraulic fluid is available. Electrical or fluid energy is provided to the auxiliary motor 110 through suitable lines 112.

Figure 8:
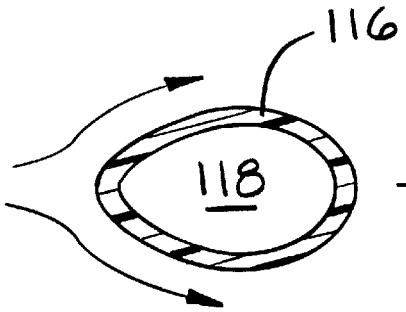
FIG. 8 is a full, sectional view of a hollow spoke of a second alternate embodiment fan shroud having an integral air supply according to the present invention taken along line 8—8 of FIG. 6.

An appropriately streamlined inlet flange or horn 114 directs air to the paddle fan 108 and a plurality of arcuate hollow spokes 116 which define internal passageways 118 both provide fluid communication between the paddle fan 108 and the toroidal plenum 104 and support and secure the paddle fan 108, the auxiliary motor 110 and the inlet flange 114 centrally within the toroidal housing 102. Preferably, there are six arcuate spokes 116 though more or fewer may be utilized depending air flow requirements and the overall size of the installation. The inlet and outlet of each of the passageways 118 defined by the spokes 116 are offset circumferentially from one another by approximately 40°. This streamlining improves air flow and reduces kinetic energy loss in the system thereby improving its efficiency. As illustrated in FIG. 8, the spokes 116 are preferably streamlined into an oval or oblate cross section, the longer cross sectional axis oriented parallel to the air flow through the center of the toroidal housing 102 created by the fan 20. Such streamlining also reduces kinetic energy losses and improves the efficiency of the fan 20.

As illustrated in FIG. 7, the toroidal housing 102 is preferably formed to include an internal scrolled edge 122 which, with a generally smoothly curved portion of the housing 102, forms a throat 124 having its terminus adjacent a Coanda, i.e., smoothly curved, circumferential surface 126. The width of the narrowest portion of the throat 124 is preferably in the range of from 0.5 millimeters to about 5 millimeters and, as noted previously, the pressure of the air within the toroidal plenum 104 is preferably in the range of 2 to 10 inches of water (4 to 20 Torr). The selection of an optimum combination of width of the throat 124 and operating air pressure will depend upon many variables such as engine fan speed and variations thereof as well the pressure rise (differential) across the engine fan and its variance with varying speed, the radial gap between the tips of the fan blades 22 and the toroidal housing 102 as well those specific operating conditions deemed to dictate that operating condition where the highest engine fan efficiency is needed.

Figure 9:
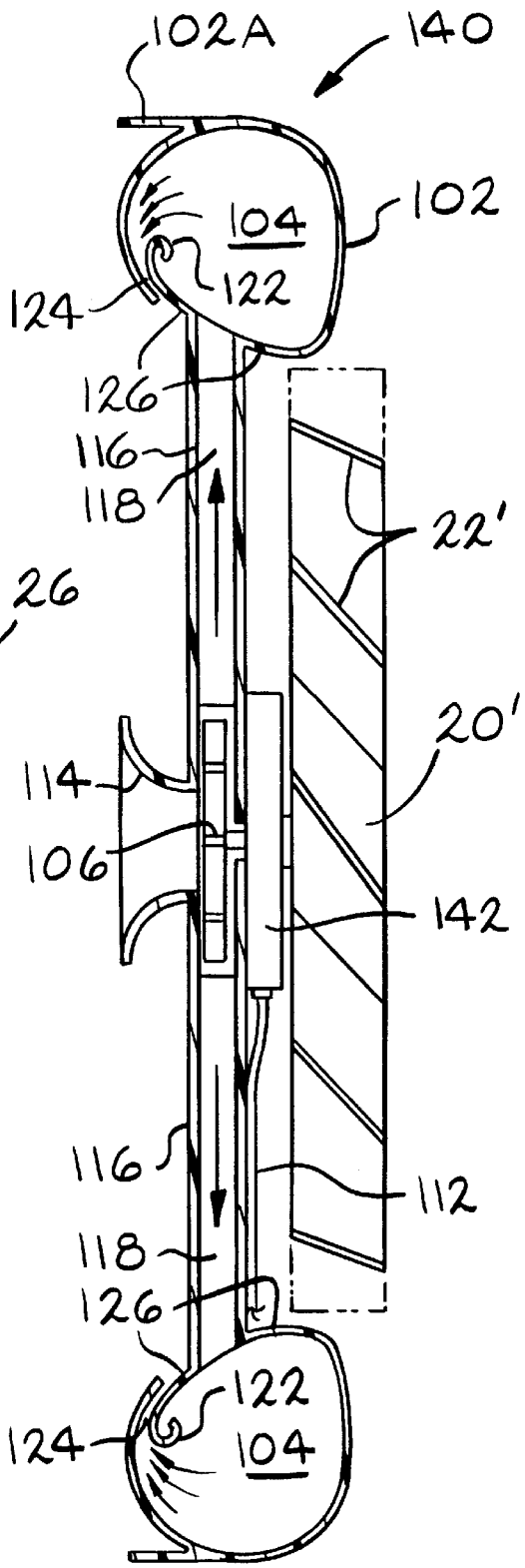
FIG. 9 is a third alternate embodiment of a fan shroud having an integral air supply according to the present invention taken along line 7—7 of FIG. 6.

FIG. 9 illustrates a third alternate embodiment of the motor vehicle fan shroud assembly 100 having an integral air supply which has been designated 140. The third alternate embodiment fan shroud assembly 140 is similar in all significant respects to the second alternate embodiment fan shroud assembly 100 and includes the toroidal housing 102 which defines the toroidal plenum 104, the paddle fan 108, the air inlet flange 114, the streamlined spokes 116, the circumferential scroll 122, the circumferential throat 124 and circumferential Coanda surface 126.

In the third alternate embodiment fan shroud assembly 140, however, the motor vehicle fan 20' which may be the same as the fan 20 of the preferred embodiment or have adjusted dimensions which are larger or smaller than the fan 20 is not driven by the motor vehicle 12. Rather, it is directly coupled to the output of a larger auxiliary motor 142 such as an electric pancake motor or hydraulic motor having sufficient power output to drive both the engine fan 20' and the paddle fan 108.

It will be appreciated that in the third alternate embodiment fan shroud assembly 140, since the engine fan 20' is secured to and driven by the auxiliary motor 142 which is supported and secured to components of the fan shroud assembly 100, the engine fan 20' thus does not exhibit significant radial motion relative to the toroidal housing 102. Accordingly, the clearance between the tips of the fan blades 22 and the toroidal housing 102 may be significantly reduced either by increasing the diameter of the fan 20' and fan blades 22 or reducing the inside diameter of the toroidal housing 102. By reducing this clearance, the efficiency of the fan 20' is improved and, of course, further improved through the use of the Coanda effect generated by the flow of air out the throat 124 and along the Coanda surface 126.

Figure 10:
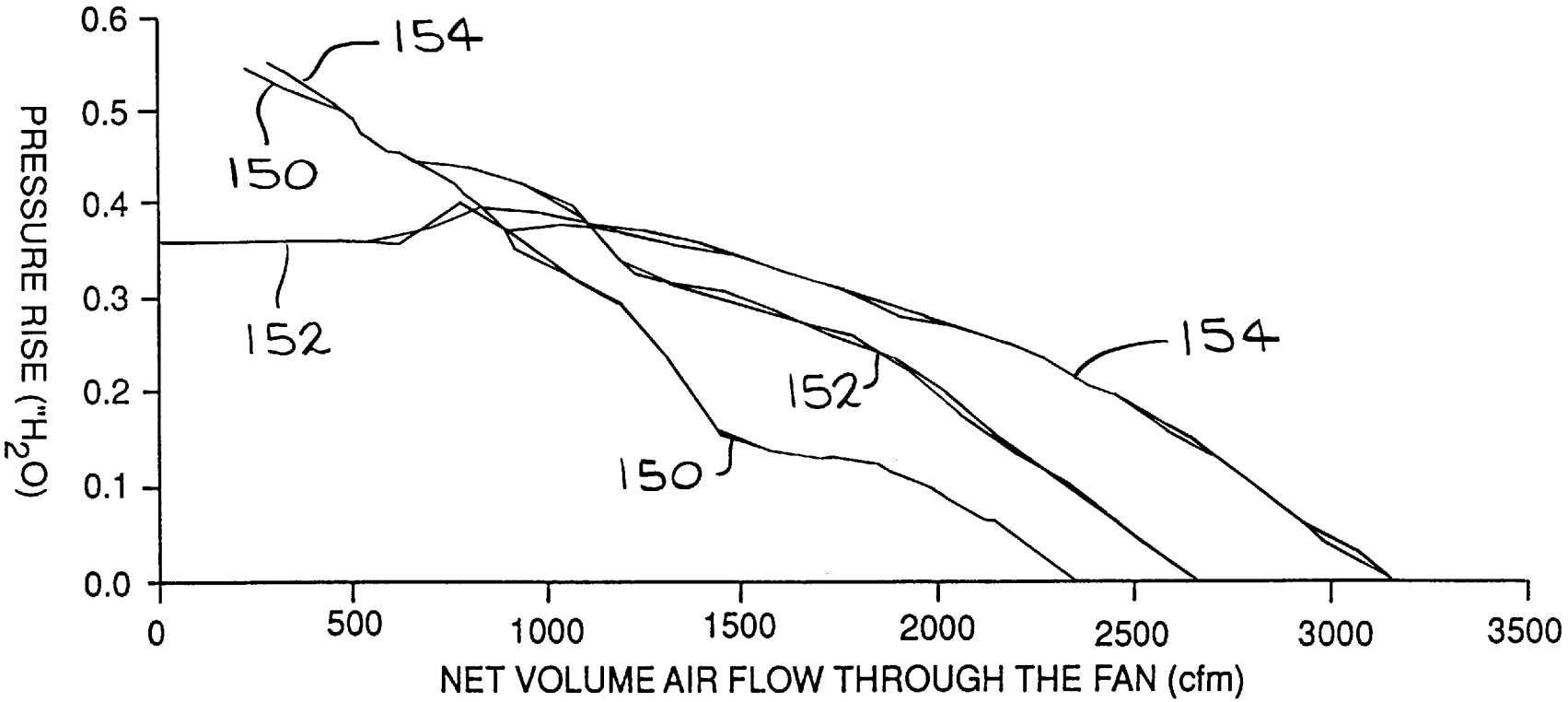
FIG. 10 is a graph which presents performance curves for various motor vehicle cooling fan shroud configurations.
Figure 11:
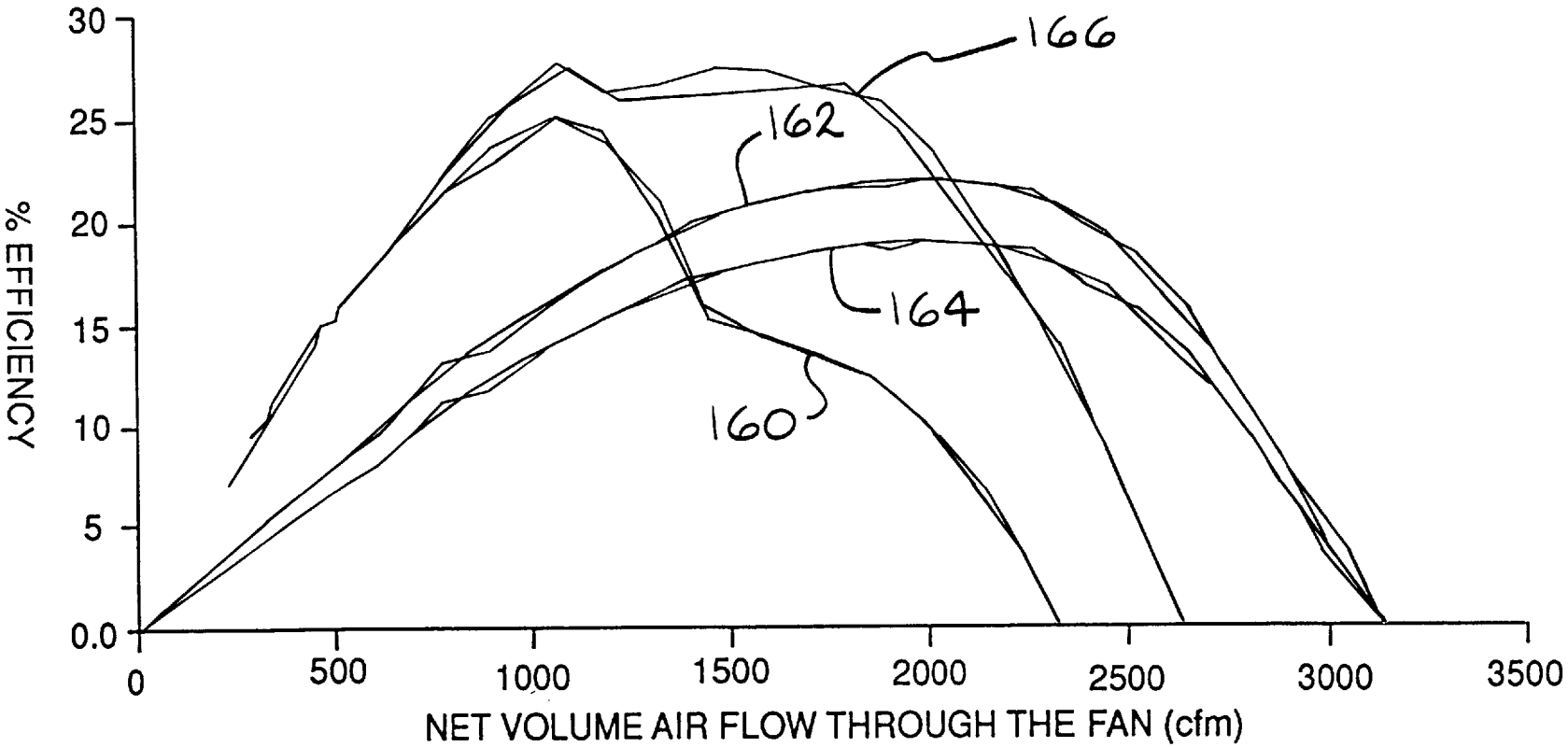
FIG. 11 is a companion graph which presents efficiency curves for various motor vehicle cooling fan shroud configurations.
Figure 12:
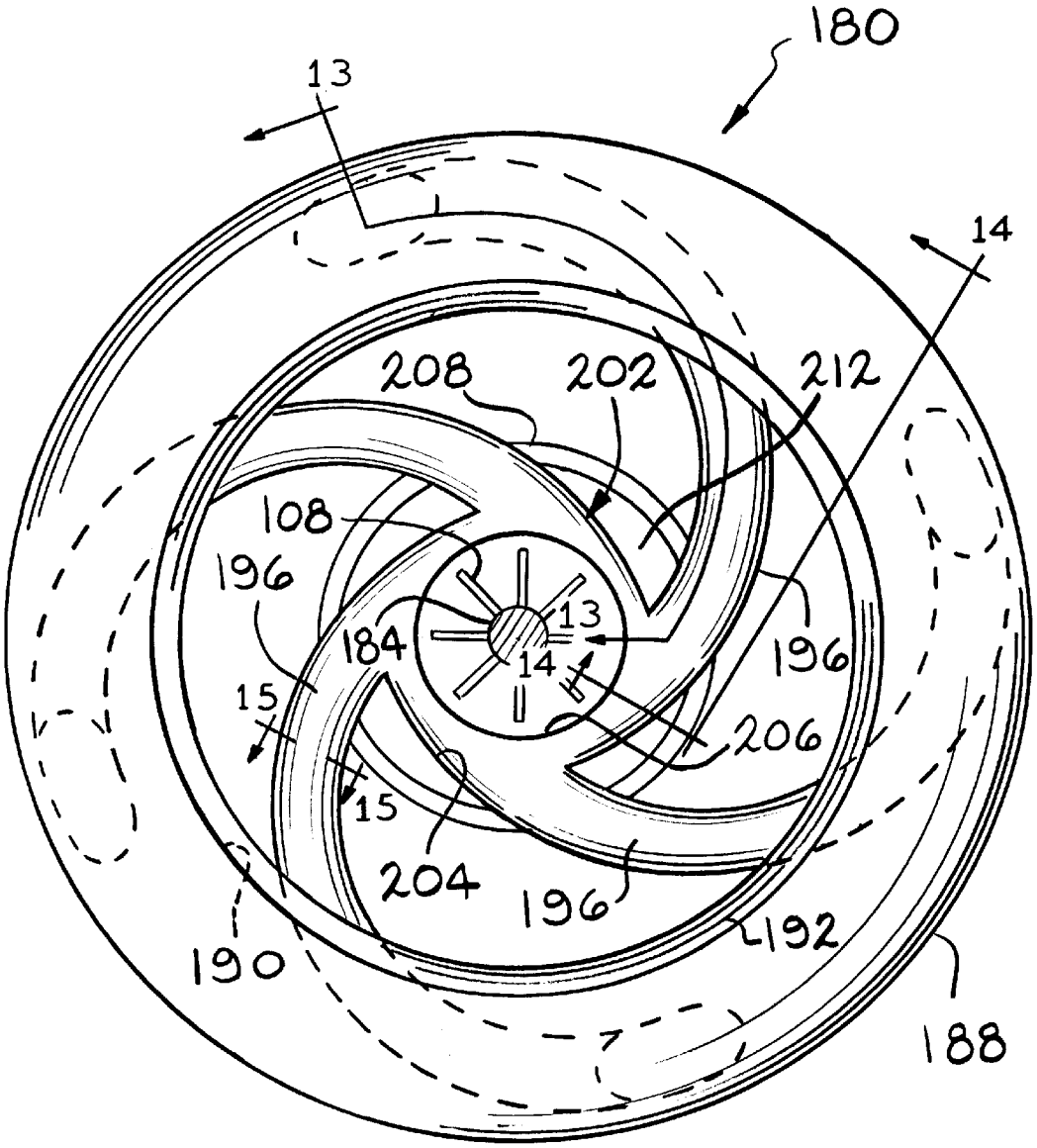
FIG. 12 is a front, elevational view of a fourth alternate embodiment fan shroud having an integral air supply according to the present invention.
Figure 13:
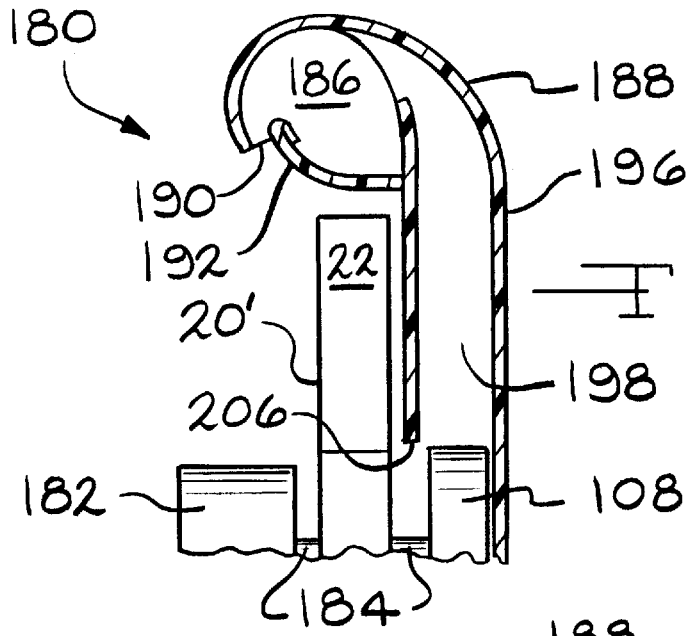
FIG. 13 is a fragmentary, sectional view of a fourth alternate embodiment fan shroud having an integral air supply according to the present invention taken along line 13—13 of FIG. 12.
Figure 14:
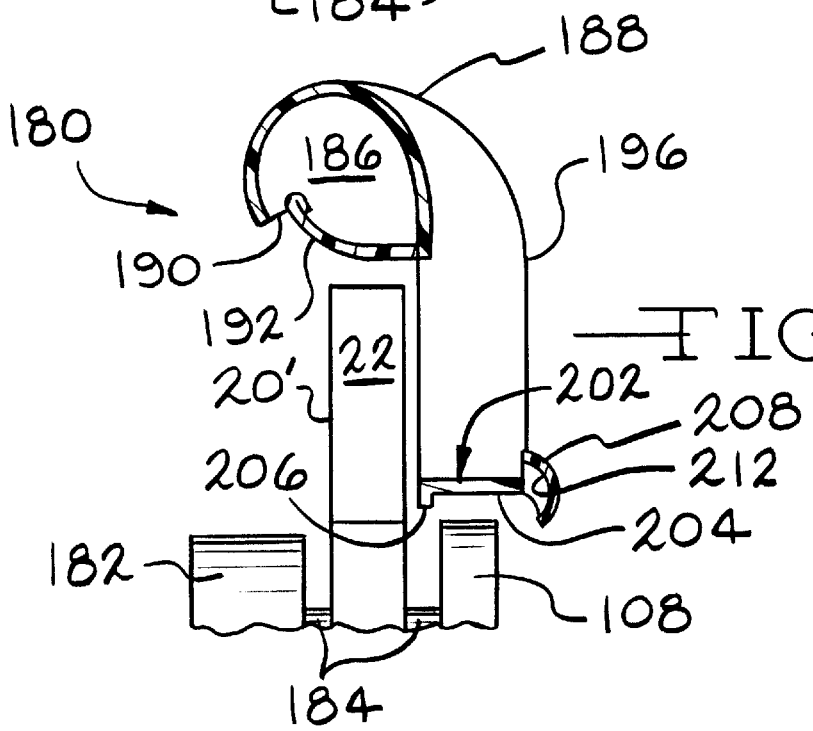
FIG. 14 is a fragmentary, sectional view of a fourth alternate embodiment fan shroud having an integral air supply according to the present invention taken along line 14—14 of FIG. 12.

FIGS. 10 and 11 present performance and efficiency data in the form of curves or plots relating to various configurations and operating conditions of the motor vehicle fan shrouds assemblies 100 and 140 described above. In both graphs, the horizontal or X axis (abscissa) represents net volume air flow through the fan 20 in cubic feet per minute.

In FIG. 10, the vertical or Y axis represents pressure rise across the fan 20 in fractional inches of water pressure. Three plots appear on this graph, each plot comprising two traces corresponding to two tests or data gathering runs. The first plot or curve 150 indicates performance of a typical conventional fan and shroud combination. Note that the curve 150 is both the most irregular and that it defines, on average, the steepest slope which suggests that this configuration has the smallest useful, i.e. consistent, operating range. A second performance curve 152 is an idealized curve which represents zero clearance between the tips of the fan blades 22 and the adjacent surface of the toroidal housing 102 such that reverse flow in this region is effectively eliminated. Here, the shape of the performance curve 152 is smoother than the curve 150, suggesting that performance is more consistent and the slope is smaller than that of the curve 150, suggesting that the operating range of the cooling fan is wider. A third curve 154 presents performance of a motor vehicle fan shroud 100 having a Coanda surface 126 such as those described hereinbefore. Note that overall, the performance curve 154 is the smoothest and most regular and that its slope is the least, i.e. flattest, of the three performance curves. This suggests the widest operating range and the most predictable and uniform operating characteristics of the three configurations over that range.

Turning now to FIG. 11, four efficiency curves each of which again consists of data from two test or data gathering runs are presented. In this graph, the vertical or Y axis represents fan efficiency in percent. A first efficiency curve 160 relates to curve 150 and represents, as in FIG. 10, a combination of a current or standard motor cooling fan and shroud having conventional geometry. Note again, that the curve 160 relating to this configuration is the most irregular, defines the most steeply sloping curves but also defines the sharpest peak in the region of approximately 1000 cubic feet per minute which achieves the highest fan efficiency of approximately 25 percent. However, the curve 160 drops rapidly with either increasing or decreasing air flow from the maximum efficiency at approximately 1100 cubic feet per minute. A performance curve 162 represents the efficiency of the second alternate embodiment fan shroud 100 according to the present invention at various air flows through the fan 20 with an assumed Coanda surface 126 air supply efficiency of 100%. Note that the efficiency curve 162, while it does not reach the highest numerical efficiency achieved by the conventional fan shroud, is much smoother and contains a significantly larger area under its curve indicating that on a relative scale, higher efficiencies are achieved over a wider range of air flow through the fan 20. The maximum efficiency of about 20% is achieved over the flow range of about 1800 to 2200 cubic feet per minute.

An efficiency curve 164 also represents efficiency data for the second alternate embodiment fan shroud 100 and Coanda surface 126 having an air supply efficiency of 70 percent. This is a more realistic assumption regarding the overall efficiency of the vehicle cooling fan 20 and the paddle fan 108. Again, note that the curve 164 is relatively smooth and flat and that it contains a relatively large area thereunder. It is, of course, lower than the efficiency curve 162, reflecting the reduced efficiency of the paddle fan 108 and thus the overall system. The maximum efficiency of 18% is also achieved over an air flow volume of approximately 1800 to 2200 cubic feet per minute. Finally, a curve 166 is a companion to the performance curve 152 of FIG. 10 reflecting data from an ideal zero clearance operating condition. Here, not only is the maximum efficiency achieved the highest but such high efficiency is enjoyed over a significantly wide range of fan volumes from approximately 1000 cubic feet per minute to approximately 1800 cubic feet per minute. This efficiency curve reinforces the importance of maintaining minimum clearance between the tips of the fan blades 22 and the shroud housing 102.

Referring now to FIGS. 12, 13, 14 and 15, a fourth alternate embodiment of a fan shroud assembly is illustrated and generally designated by the reference number 180. The fourth alternate embodiment fan shroud assembly 180 is generally similar to the third alternate embodiment fan shroud assembly 140 in that a single electric or hydraulic drive motor 182 commonly drives both the fan 20' including a plurality of fan blades 22 and the centrally disposed paddle radial blade or paddle fan 108. The differences existing in the fourth alternate embodiment shroud assembly 180 distinguishing it from the other alternate embodiments, particularly the third alternate embodiment assembly 140 relate to the shroud assembly 180 itself. Specifically, the shroud assembly 180 defines a generally toroidal plenum 186 defined by a molded or formed housing 188. The housing 188 may include various flanges and mounting ears such as the flanges 102A illustrated in FIGS. 7 and 9. The housing 188 also defines an obliquely disposed throat 190 which communicates with the toroidal plenum 196 and is disposed adjacent a circumferential curved Coanda surface 192. The width of the throat 190 and other specific operating variables such as air pressure are typically within the same ranges described above with regard to the second and third alternate embodiment assemblies 100 and 140.

The fourth alternate embodiment fan shroud assembly 180 includes a plurality of hollow spokes 196 defining interior passageways deliver air under low pressure from the radial or paddle fan 108 into the toroidal plenum 186. As readily apparent from FIG. 12, the hollow spokes 196 are significantly curved and streamlined, their curvature in plan defining a generally involute curve. The angular offset from the inlet to the outlet of the spokes 196 is approximately 120° and is preferably at least between 100° to 140°. Such significant angular curvature or offset from inlet to outlet results in a highly streamlined air flow which reduces kinetic energy loss thereby improving the overall efficiency of the alternate fourth embodiment fan shroud assembly 180. While four of the spokes 196 are illustrated and generally represent the preferred number of such spokes 196, it should be appreciated that more or fewer of the spokes 196 may be utilized, with consideration given to the following trade-offs. First of all, utilizing a larger number of the spokes 196 provides the capability of increased air flow or reduced energy loss between the paddle fan 108 and the toroidal plenum 186. Unfortunately, the use of additional, highly curved (streamlined) spokes 196 will create increasing areas of blockage to the axial flow from the fan 20'. Likewise, utilizing the same number of the spokes 196 but enlarging them will also increase blockage of the axial air flow. Contrariwise, reducing the size or number of the spokes 196 will reduce the blockage and thus improve the throughput of the fan 20 but reduce air flow from the paddle fan 108 to the toroidal plenum 186 and increase energy losses therebetween.

At the center of the fourth alternate embodiment fan shroud assembly 180, supported by the spokes 196, is a multiple internally scrolled fan housing 202 having a plurality of air directing surfaces 204 associated with each of the passageways 198 and the hollow spokes 196. The fan housing 202 defines a large circular opening 206 facing upstream, i.e., toward the fan 20' which provides air to the paddle fan 108 and also includes an interrupted flow reversing guide or deflector 208 which extends in discontinuous sections between adjacent regions of each of the hollow spokes 196. Each section of the guide or deflector 208 includes a complexly, i.e., both radially and circumferentially, curved surface 212 which reverses axial flow from the fan 20' and directs it back toward the radial or paddle fan 108.

Figure 16:
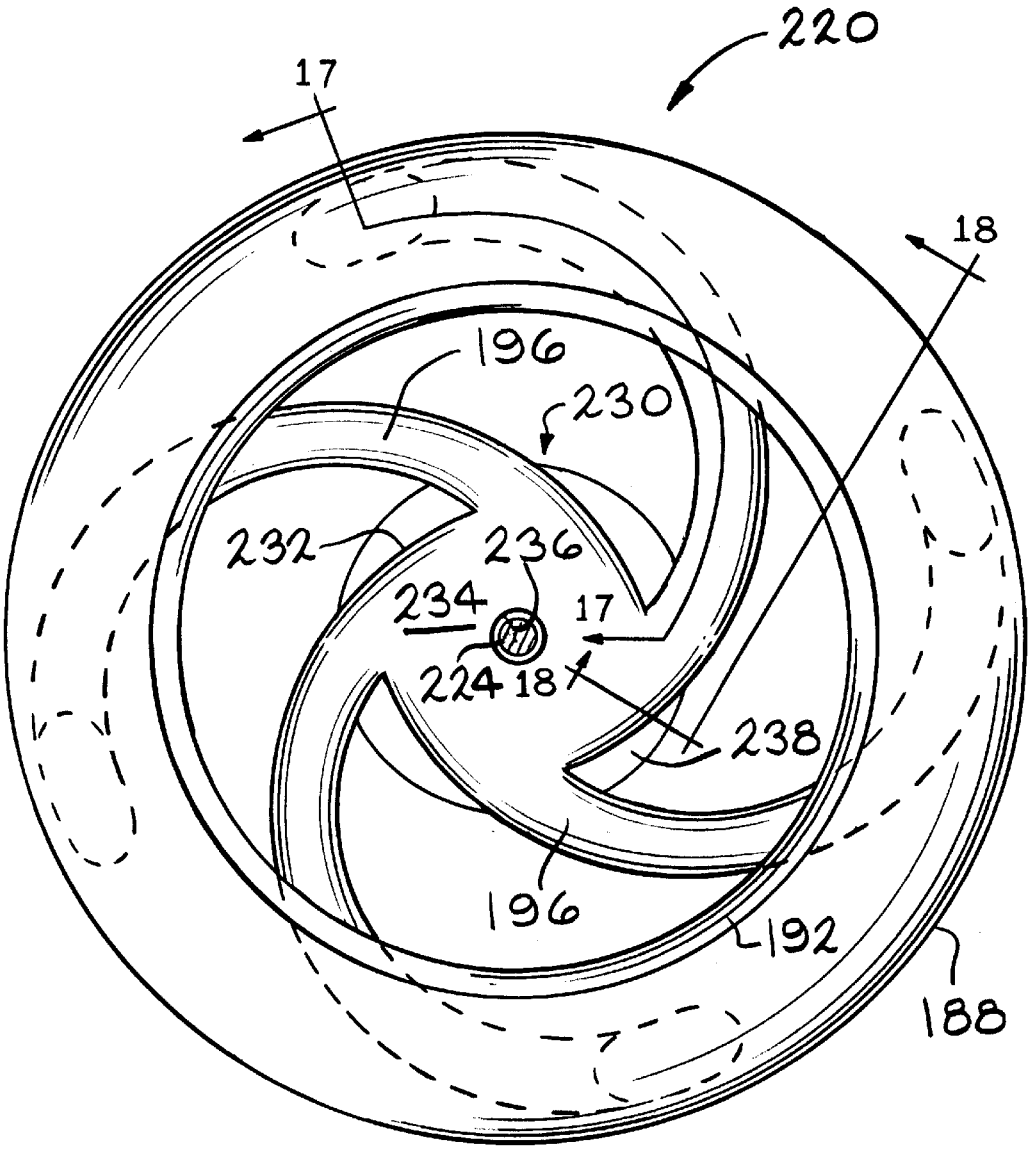
FIG. 16 is a front, elevational view of a fifth alternate embodiment fan shroud having an integral air supply according to the present invention.
Figure 17:
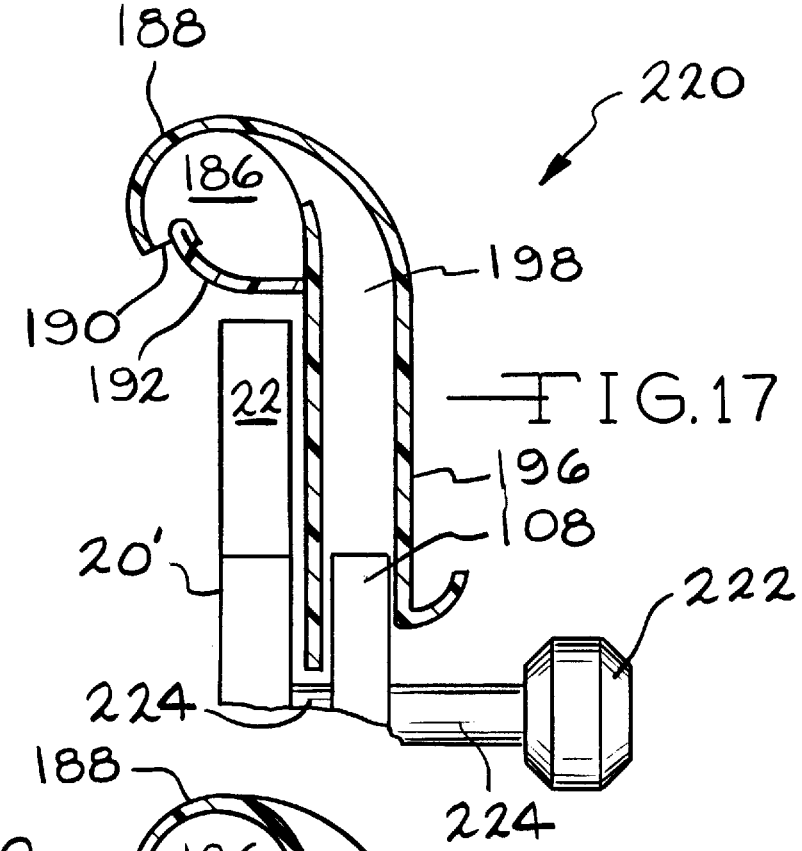
FIG. 17 is a fragmentary, sectional view of a fifth alternate embodiment fan shroud according to the present invention taken along line 17—17 of FIG. 16.
Figure 18:
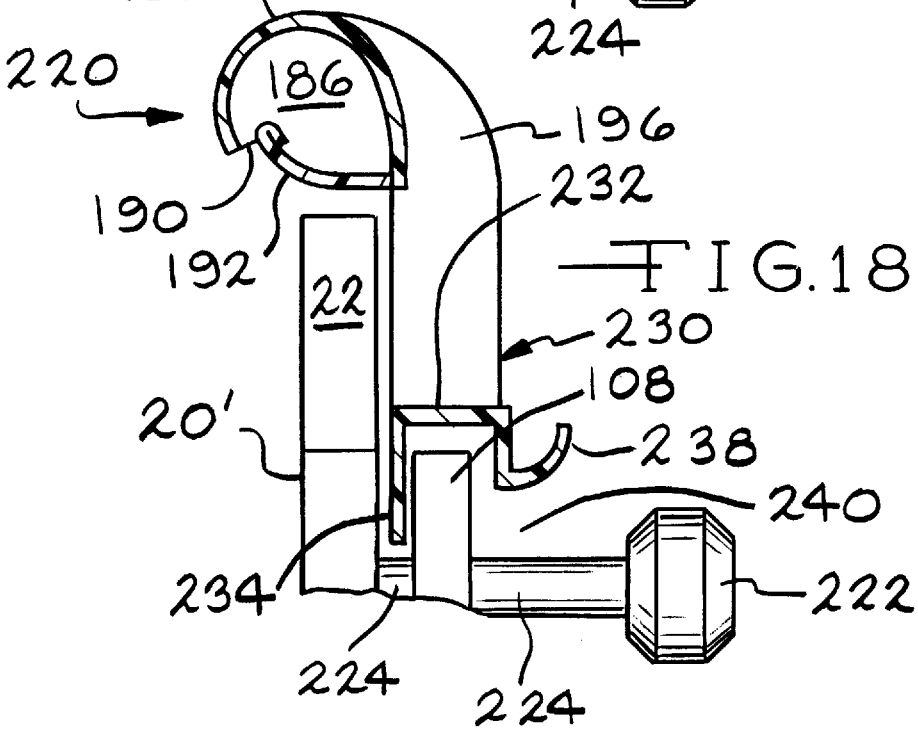
FIG. 18 is a fragmentary, sectional view of a fifth alternate embodiment fan shroud according to the present invention taken along line 18—18 of FIG. 16.

Referring now to FIGS. 16, 17 and 18, a fifth alternate embodiment of the fan shroud assembly is illustrated and generally designated by the reference number 220. The fifth alternate embodiment fan shroud assembly 220 is generally similar to the fourth alternate embodiment fan shroud assembly 180 but for details relating to the centrally disposed fan 108 and housing thereof. Accordingly, the fifth alternate embodiment assembly 220 includes an electric or hydraulic motor 222 which drives the radial or paddle fan 108 and the fan 20' having blades 22 through a shaft 224. The drive motor 222 may be either electrically or hydraulically powered, as noted above.

Figure 15:
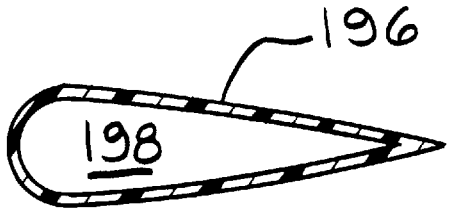
FIG. 15 is a full, sectional view of a hollow spoke of a fourth alternate embodiment fan shroud having an integral supply according to the present invention taken along line 15—15 of FIG. 12.

The fifth alternate embodiment shroud assembly 220 is generally similar to the fourth alternate embodiment 180 and includes a plurality of preferably involutely curved spokes 196 defining the cross section illustrated in FIG. 15 and defining hollow interior passageways 198 which extend from the fan 108 to the toroidal plenum 186. The housing 188 also defines a obliquely, inwardly directed throat 190 disposed adjacent a circumferential Coanda surface 192. The width of the throat 190 and the operating pressures of the shroud assembly 220 are like those discussed above with regard to the third alternate embodiment assembly 140 and the fourth alternate embodiment assembly 180.

Centrally disposed within the fifth alternate embodiment assembly 220 is a central fan housing 230 which defines involute sidewalls 232 which are associated with each of the spokes 196 and provide a smooth streamlined, low energy loss flow path for the air from the paddle fan 108 through the hollow spokes 196 and into the interior of the toroidal plenum 186. The fan housing 230 also includes a radially inwardly extending wall 234 having a central aperture 236 which receives the shaft 224. The inlet to the fan housing 230 faces downstream of the air flow from the fan 20' and includes a circumferential throat 238 which defines a smooth streamline into a fan inlet opening 240 which provides air to the paddle fan 108. The fifth alternate embodiment shroud assembly 220 thus provides the same high kinetic energy transfer and low energy loss from the fan 108 to the plenum 186 of the fourth alternate embodiment shroud assembly 180 but provides flexibility of positioning the drive motor 222 on the downstream side of the fans 20' and 108.

The foregoing disclosure is the best mode devised by the inventor for practicing this invention. It is apparent, however, that apparatus and methods incorporating modifications and variations will be obvious to one skilled in the art of fluid flow. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. A shroud assembly for improving the operating efficiency of a fan comprising, in combination, a shroud adapted for disposition about a first fan, said shroud defining a plenum and having a substantially circular opening for receiving such fan, a substantially continuous throat extending around said opening and communicating with said shroud plenum, a fan housing, a second fan disposed in said fan housing, and a plurality of air passages extending between said fan housing and said shroud plenum.

2. The shroud assembly of claim 1 further including a curved circumferential surface adjacent said substantially continuous throat.

3. The shroud assembly of claim 2 wherein said curved surface is a Coanda surface and wherein air is supplied to said interior passage at a pressure of less than about 10 inches water gauge.

4. The shroud assembly of claim 1 further including a plurality of radial webs disposed across said substantially continuous throat.

5. The shroud assembly of claim 1 wherein said shroud is axisymmetric about the axis of such fan.

6. The shroud assembly of claim 1 wherein said shroud is disposed adjacent a motor vehicle radiator and said first fan is disposed upon and driven by a prime mover of such motor vehicle.

7. The shroud assembly of claim 1 further including a drive motor and wherein said first fan and said second fan are commonly driven by said motor.

8. A shroud assembly for improving the efficiency of a fan comprising, in combination, a shroud having a circular opening for receiving such fan, a substantially continuous throat disposed adjacent said opening, a substantially continuous curved surface disposed adjacent said throat and extending around said opening, a plenum providing substantially continuous fluid communication with said throat, air moving means centrally disposed in said shroud, and at least two air handling ducts extending between said air moving means and said plenum.

9. The shroud assembly of claim 8 wherein said curved surface is a Coanda surface.

10. The shroud assembly of claim 8 wherein said ducts are curved and define inlets angularly displaced from outlets by at least 100°.

11. The shroud assembly of claim 8 further including a plurality of webs transversely disposed across said throat.

12. The shroud assembly of claim 8 wherein said air moving means includes a drive motor and fan.

13. The shroud assembly of claim 12 further including a second fan disposed in said circular opening and operably coupled to said drive motor.

14. The shroud assembly of claim 8 wherein said shroud is disposed adjacent a motor vehicle radiator and said fan is disposed upon and driven by a prime mover of such motor vehicle.

15. A shroud assembly for improving the efficiency of a fan comprising, in combination, a shroud housing defining a circular opening adapted to receive a fan and a toroidal plenum, a throat disposed adjacent said opening and providing fluid communication with said plenum, a curved surface disposed adjacent said throat and extending around said opening, air moving means disposed in said circular opening, and at least two air handling ducts extending between said air moving means and said plenum.

16. The shroud assembly of claim 15 wherein said curved surface is a Coanda surface.

17. The shroud assembly of claim 15 wherein said at least two air handling ducts are curved and define inlets angularly displaced from outlets by at least 100°.

18. The shroud assembly of claim 15 wherein said air moving means includes a drive motor and fan.

19. The shroud assembly of claim 15 wherein said shroud housing is disposed adjacent a motor vehicle radiator and further including a fan disposed in said circular opening.

20. The shroud assembly of claim 19 further including a drive motor operably coupled to said air moving means and said fan.

* * * * *